US005961735A

United States Patent [19]

Heitmann, Jr. et al.

[11] Patent Number: 5,961,735

[45] **Date of Patent: *Oct. 5, 1999**

[54] METHOD OF CLEANING PAPERMAKING FELTS WITH ENZYMES

[75] Inventors: John A. Heitmann, Jr.; Thomas W. Joyce, both of Raleigh, N.C.

[73] Assignee: North Carolina State University, Raleigh, N.C.

[ * ] Notice: This patent issued on a continued prosecution application filed under 37 CFR 1.53(d), and is subject to the twenty year patent term provisions of 35 U.S.C. 154(a)(2).

[21] Appl. No.: 08/869,879

[22] Filed: Jun. 5, 1997

Related U.S. Application Data

[63] Continuation of application No. 08/493,081, Jun. 21, 1995, abandoned.

[51] Int. Cl.[6] ..... B08B 1/02

[52] U.S. Cl. ..... 134/15; 134/21; 134/22.14; 134/22.19; 134/24; 134/26; 134/32; 162/72; 162/199; 162/274; 162/275; 162/278; 162/DIG. 4

[58] Field of Search ..... 134/15, 22.14, 134/21, 22.19, 24, 26, 32; 162/199, 274, 275, 278, 72 B, 72, DIG. 4

[56] References Cited

U.S. PATENT DOCUMENTS

| | | | |
|---|---|---|---|
| 3,257,268 | 6/1966 | Wrist et al. | 162/199 |
| 3,966,544 | 6/1976 | Johnson | 162/199 |
| 4,002,789 | 1/1977 | Heim et al. | 162/199 |
| 4,398,996 | 8/1983 | Bolton et al | 162/199 |
| 4,698,134 | 10/1987 | Green et al. | 162/199 |
| 4,861,429 | 8/1989 | Barnett et al | 162/DIG. 4 |
| 4,995,944 | 2/1991 | Aston et al. | 162/199 |
| 5,073,235 | 12/1991 | Trokhan | 162/199 |
| 5,110,412 | 5/1992 | Fuentes et al. | 162/72 B |
| 5,116,474 | 5/1992 | Fuentes et al. | 162/71 |
| 5,238,501 | 8/1993 | Kappel et al. | 134/15 |
| 5,256,252 | 10/1993 | Sarkar et al. | 162/72 |
| 5,368,694 | 11/1994 | Rohlf et al. | 162/189 |
| 5,427,653 | 6/1995 | Andersson et al. | 162/199 |

FOREIGN PATENT DOCUMENTS

| | | |
|---|---|---|
| 0279089 | 8/1988 | European Pat. Off. . |
| 0351655 | 1/1990 | European Pat. Off. . |
| WO9102839 | 8/1989 | WIPO . |
| WO9216687 | 3/1991 | WIPO . |

*Primary Examiner*—Lyle A. Alexander
*Assistant Examiner*—S. Carrillo
*Attorney, Agent, or Firm*—Myers Bigel Sibley & Sajovec, P.A.

[57] ABSTRACT

A method of treating a felt to remove contaminants therein comprises the steps of providing a felt used in transporting paper webs, preparing an enzyme solution comprising an enzyme selected from the group consisting of a cellulase, a hemicellulase, and mixtures thereof, applying the enzyme solution to the felt for a first predetermined period of time, rinsing the felt with water, applying a solution of sodium hydroxide to the felt to remove the enzyme solution, and rinsing the felt with water to remove the sodium hydroxide solution thereby removing the contaminants in the felt.

5 Claims, 1 Drawing Sheet

METHOD OF CLEANING PAPERMAKING FELTS WITH ENZYMES

CROSS-REFERENCE TO RELATED APPLICATIONS

The instant application is a file wrapper continuation of Ser. No. 08/493,081 filed Jun. 21, 1995, now abandoned.

TECHNICAL FIELD

This invention relates generally to methods for the cleaning of forming fabrics or wet press felts for paper machinery and particularly to the use of enzymes in such methods.

BACKGROUND OF THE INVENTION

The manufacture of paper typically involves the processing of a carefully prepared aqueous fiber suspension to produce a highly uniform dry paper sheet. Three steps included in the typical process are sheet forming, where the suspension is directed over a porous mesh or "wire" upon which fibers are deposited while liquid filters through the wire, sheet pressing, where the formed sheet is passed through presses covered with porous "felt" to extract retained water from the sheet, to improve the sheet's uniformity, and to impart surface quality to sheet; and paper drying, where residual water is evaporated from the sheet. The sheet may then be further processed into the finished paper product.

It is well known that evaporation of water is energy intensive and thus relatively expensive. Consequently, efficient papermaking is dependent upon extracting water during the forming and pressing operations, and avoiding sheet defects which render the dried sheet unfit for use. Felts and wires are thus particularly important because they affect not only water removal but, because of their intimate contact with the sheet, the quality of the sheet itself. Deposits allowed to collect on the felt or wire can affect its water removal efficiency, can cause holes in the sheet, and can be transferred to the sheet material to create defects.

The quality of the aqueous fiber suspension used to produce the sheet is dependent upon many factors, including the wood and water used as raw materials, the composition of any recycled material added to the process, and the additives used during preparation of the suspension. Thus a variety of dissolved or suspended materials can be introduced into the manufacturing process, including both inorganic materials such as salts and clays, and materials which are organic in nature such as resins (also referred to as "pitch"), fine cellulosic fibers and other particles from the wood, as well as inks, latex, and adhesives from recycled paper products. A build up of deposits containing inorganic and/or organic materials on felts and other sheet forming equipment during the manufacturing process is recognized as a troublesome obstacle to efficient papermaking. Particularly troublesome are the sticky materials such as glues, resins, gums and the like which are associated with recycled fibers.

Methods of quickly and effectively removing deposits from the papermill sheet forming equipment are of great importance to the industry. The paper machines could be shut down for cleaning, but ceasing operation for cleaning is undesirable because of the consequential loss of productivity. On-line cleaning is thus greatly preferred where it can be effectively practiced.

The wire belt or cylinder used for sheet forming cycles continuously, as a belt, during production. The sheet-contact portion of the cycle begins where application of the fiber suspension to the wire belt or cylinder is started and continues until the formed sheet is separated from the wire surface; and the return portion of the cycle returns the wire from the position where the formed sheet has been removed from its surface to the beginning of the sheet-contact portion. With wire belts such as Fourdrinier wires, on-line wire cleaning has generally been performed during.the return stage (i.e. where the wire is not in contact with the forming sheet) by treating the returning wire with a cleaning liquid (typically water). Often the wire is showered with liquid under pressure, which may be further assisted by mechanical surface cleaning. Use of water showers, with or without mechanical assistance, has not proved entirely satisfactory in removing a build-up of either organic compounds or inorganic deposits on the wires, and additional materials have been used to provide cleaning liquids which are more effective. Predominantly fibrous or inorganic materials have been successfully removed using water-based formulations containing either acids or alkalis formulated with other chemicals such as surfactants. Where organic deposits are prevalent, they have been removed with some success by using organic solvents, including some formulations containing aromatic compounds with low flash points or chlorinated hydrocarbons. In most machines polyester fabric belts are now used instead of the more traditional wires.

Papermill felts also commonly circulate continuously in belt-like fashion between a sheet contact stage and a return stage. During the sheet contact stage water is drawn from the sheet usually with the aid of presses and/or vacuum into the pores of the felt. A clean felt, having fine pores which are relatively open, is especially desirable for effective paper manufacture since this allows efficient removal of water from the paper sheet. A felt cleaning procedure should remove both organic and inorganic deposits of both a general and localized nature, maintain felt porosity, and condition the fabric nap without chemical or physical attack on the substrate. However, cleaning liquids are also utilized to remove troublesome build-up of organic and inorganic deposits. The fabric composition and conformation of many papermill felts makes them susceptible to chemical degradation. The cleaning chemicals should be easily removed by rinsing. Both continuous and shock cleaning is used in most papermills. The chemicals used include organic solvents, often chlorinated hydrocarbons. Acid and alkali based systems are also used, but at lower concentrations than used in wire cleaning. High concentrations of alkali metal hydroxides are often unsuitable for felt cleaning as they "attack" the fabric material.

Some of the more successful organic solvents have been identified as health risks, such as carcinogens, and thus require especially careful handling. Other solvent based products can damage plastic or rubber components used in the paper forming process. One on-line treatment of felts which we know has been used for several years with some success involves contacting the felt with aqueous solution of cationic surfactants such as alkyldimethyl benzyl ammonium chloride wherein the alkyl group consists of a mixture of $C_{12}H_{25}$, $C_{14}H_{29}$ and $C_{16}H_{33}$ groups. However, experience has shown that some sticky materials will tend to adhere to felts despite treatment with these surfactants. Another felt conditioning practice which has been advocated in the past is application of aqueous solutions of cationic polymers to the felts. However this type of treatment can actually lead to a build-up of deposit of materials derived from the cationic polymers themselves.

Other sheet forming equipment such as deckers, filters, screens, and rolls can also become fouled. The process problems and treatments are, as a general rule, similar to the felt system, although certain considerations such as maintaining porosity and avoiding chemical degradation of fabric, which are important in felt cleaning and cleaning certain other fine-pored equipment components, may not be so critical for this other equipment.

Natural resin or gum in fresh wood can vary, depending on the species. Some types of pine wood, especially those containing 2 weight percent or more of resin, are commonly used in only very low percentages due to the gum and resin problems they cause. Papermakers alum or sodium aluminate have been traditionally used to control natural wood resin deposits. These products are added into the total pulp system with the objective of depositing the resin on the fiber. The effectiveness of this approach is limited by such factors as pH, the potential for corrosion, paper sheet formation, and the need to control interaction with other chemicals in the pulp system. Treatments which would permit the unrestricted use of these problem pine wood sources could have significant beneficial economic impact on some pulp and paper producers.

The increasingly more common use of recycled fiber has contributed to more serious build-ups of sticky material during paper formation. The glues, resins, gums, etc. which are found in recycled, secondary fiber tend to adhere to various parts of the paper-forming machine and to resist on-line shower cleaning. The materials which adhere to the felt can seriously affect drainage and paper formation. The end result in the product is holes, and ultimately, in some cases, breaks in the sheet during paper processing. Frequent shutdown may be necessary to solvent wash the felt to remove the particularly sticky material associated with recycled fiber. The advantages of paper recycling can thus be somewhat offset by reduced productivity of the papermaking machines.

EPA No. 279,089, for example, discloses the use of such organic cleaners with an alkali in both water and an organic cosolvent.

Another approach to deposit control has been the use of pulp additives such as anionic aryl sulfonic acidformaldehyde condensates or cationic dicyandiamide-formaldehyde condensates. The additives may function for example as sequestrants, dispersing agents or surface active agents. In particular the cationic dicyandiamide-formaldehyde aminoplast resins have been described as bringing about the attachment of pitch (e.g. resinous matter and gums), in the form of discrete particles, to pulp fibers so that the pitch particles are uniformly distributed on the fibers themselves. Consequently, the amount of pitch which accumulates on the papermaking machine is reportedly reduced without causing dark spots or specks of pitch in the paper product.

U.S. Pat. No. 4,995,944 discloses that the deposit of sticky material from papermaking pulp onto papermill felts and other papermaking equipment used in processing a pulp slurry into sheets can be inhibited by applying to the equipment an aqueous solution containing 2 ppm of a cationic polymer and applying to the equipment an aqueous solution containing compounds selected from the group consisting of water-soluble non-ionic and cationic surfactants in an amount effective to inhibit build-up of deposits derived from the cationic polymer. This technique is said to be particularly beneficial when used for treating felts and like equipment components used in processing pulp slurry into sheets.

Especially in the case of wet press felts, chemical treatments such as caustic cleaning (with NaOH) or detergents are performed to weaken and remove deposits by attacking the oily or resinous components of the deposit, both on a continuous basis and with greater intensity when the machine is shut down for periodic maintenance. In addition, mechanical loosening and removal of the deposits is accomplished with the use of high pressure oscillating water showers and vacuum devices which can remove water and contaminants while the machine is in operation. The deposits are composed of inert filler materials, cellulosic components, and resinous or polymeric components which bind the other components together and into the fibrous structure of the felt. These deposits fill up the void spaces of the felt reducing porosity, hence the capability of the felt to handle water during the pressing operation. The reduction of water handling ability can reduce speed and efficiency of the paper making operation to the point where eventually the felt must be removed and replaced. In addition, nonuniformity in the build up or removal of the deposits can induce variations in the ability of the press to handle water resulting in nonuniformity of the moisture content of the paper or in operating difficulties of the paper machine.

In addition to the cleaning agents mentioned above, enzymatic preparations have been considered for the processing of pulp associated with conventional chlorine bleaching steps, e.g., WO91/02839, which discloses using xylanases, cellulases and hemicellases as a pre-treatment step before the first chlorination stage to reduce the active amount of chlorine used.

WO92/16687 discloses treating the pulp or "white water" with an enzymatic preparation, which is said to reduce pitch problems associated with mechanical pulp and/or papermaking pulp containing same. More particularly, the enzymes are said to be added at any pulp production stage after the mechanical detachment of fibers. Although this reference states that such treatment improved machine runnability and also that the felts appeared clean, use of the enzymatic preparation was limited to only the wet stage of the papermaking process. Once the paper web is transferred from the forming wires of the Fourndrier to the press felts, most of the water containing the enzyme preparation has already been driven-off. Effectiveness of this method depends upon the amount of residual enzyme available in the water passing through the press felts. In the press section referred to here as the dry stage of the machine, which is not addressed by this approach, there is negligible residual enzyme available, moreover, no new enzymatic treatment is introduced.

SUMMARY OF THE INVENTION

According to the invention, there is provided a method for reducing unwanted deposits on selected component(s) of a papermaking machine during the post-forming, i.e., "dry" stage of a papermaking operation. The method comprises the step of treating at least one of the components with an enzyme preparation exhibiting an effective amount of cellulase or hemicellulase activity to reduce or remove the unwanted deposits contained on the component selected.

An advantage of the invention is that the felt has improved water and air permeability due to the enzymatic cleaning process of the invention.

Further advantage of the invention is that a biocompatible solution is provided to improve the removal from press-felts of cellulosic and other unwanted deposits which otherwise would affect the quality of paper webs.

Another advantage of the invention is that the subject enzymatic cleaning process can be employed over a variety of operating conditions, locations, and composition of unwanted deposits.

A still further advantage of the invention is that, by successfully reducing deposits embedded within the thick synthetic mesh and batting of the felts, further use of the instant enzymatic or other cleaning methods thereby becomes more effective on the more exposed deposits of the felts.

BRIEF DESCRIPTION OF THE DRAWINGS

Further objects and advantages of the invention can be appreciated by referring to the accompanying Drawings wherein.

DETAILED DESCRIPTION

Figure 1:
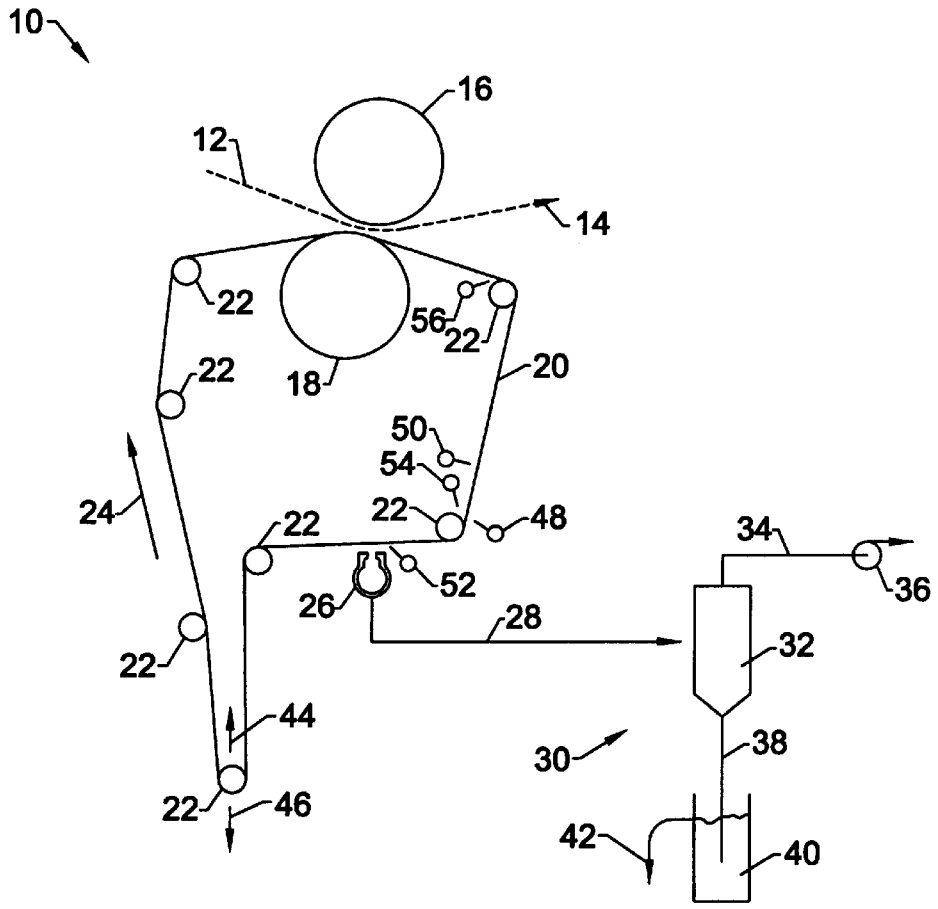
FIG. 1 is a schematic view of the dry phase in a representative papermaking machine, showing the cleaning operation contemplated by this invention.

FIG. 1 shows a conditioning system of the type useful with high synthetic modern press felts in the post-forming, i.e., "dry" stage of a papermaking operation. Representative machinery is generally shown at 10 for use in performing the dry processing steps on a paper web, shown in phantom at 12, passing through the machine 10 in the direction of arrow 14 and nipped between large rollers 16, 18. The web 12 approaches rollers 16, 18 in a "wet" state from the forming stage after exiting a headbox (not shown) then is dewatered by mechanical pressure from the rollers which drives water into a press felt 20 running in a continuous loop along a series of support rollers 22. At an intermediate point in the loop, which travels in the direction of arrow 24, a suction means 26 is situated to further remove moisture from the felt 20 through line 28 into a recycling unit, generally shown at 30. The moisture is received from line 28 by a liquid-air separator 32 and the air removed via line 34 connected to a vacuum pump 36, while the liquid passes via line 38 to seal pit 40 thence to a weir (not shown) in the direction of arrow 42.

The continuous loop made by felt 20 can be tensioned as indicated by arrows 44 and 46, respectively. Equipment components typical of machine 10 include an external high pressure shower 48 and an internal high pressure shower 50, adapted to spray opposed surfaces of the felt 20, as indicated by the small projecting reference arrows, prior to the suction means 26 and thus, are intended to hydrostatically loosen or dislodge unwanted deposits in the felt 20. An external lubricating shower 52 may be located between the suction means 26 and one of the high pressure showers 48 to inject a lubricant onto the felt 20 (small indicator arrow) which eases passage of the felt over the suction device 26. An internal flooding shower 54 further introduces liquid onto felt 20 (small indicator arrow). Near the exit of felt 20 from the nip between press-rollers 16, 18 there is typically provided an internal detergent shower 56 adapted to spray a surfactant onto felt 20 which acts further upon the unwanted deposits to penetrate them. The press rollers 16, 18 typically are each provided with circumferential grooves (not shown) which coact with one another at the nip to channel water from the felt.

According to the invention, it is feasible to adapt the above-described machine 10 to dispense an enzyme preparation onto one or more of the components, preferably the press-felt 20, or onto other components of machine 10, at selected points during the loop made by the felt. Specifically, the grooves of press-rollers 16, 18 can be treated with the enzyme preparation, according to the subject method, which acts upon unwanted deposits tending to accumulate in the grooves. Similarly, the enzyme preparation could be introduced through nozzles (not shown) of the various showers 48, 50, 52, 56 to act on unwanted deposits that may accumulate on the nozzles and showers. It will be appreciated that treatment of the various components mentioned herein can be done separately or together, in any desired sequence. Moreover, the enzyme treatment step may be performed separately, or in combination with the other conventional high pressure and surfactant cleaning methods having the activities described above.

The unwanted deposits typically comprise: a woody (fibrous) portion, which is acted upon by the preferred enzymatic preparation of cellulase/hemicellulase, described below; a mineral component, such as Titanium Dioxide, clay, etc.; and a binder component containing organic extractives, e.g., broken-down oily resins, which can be acted upon by pitch-degrading agents. With respect to the oily portion of such deposits, the use of lipases is contemplated herein as a means of degrading same in a further preferred aspect of the invention.

Although felt 20 is generally discussed herein, the specific treatment of either a press-felt, a dryer felt or both types of felts is contemplated in the post-forming stage, according to the invention.

One of the preferred methods of delivering the enzyme preparation to the selected components being treated is by utilizing an existing nozzle of one of the showers 48, 50, 52, 56. Hence, detergent shower 56 could be used to treat press-rollers 16, 18, alternatively, high pressure shower 50, could be used to dispense an enzyme preparation onto the felt 20. Of course, such enzyme treatment steps could be accomplished separately or in tandem, as alluded to generally above.

It will be appreciated by those skilled in the art that a plurality of felt loops could be provided for dewatering the web 12, each with its own cleaning system. Likewise, the felt may be cleaned either continuously while it is running; or intermittently while the machine is stopped, by treating portions of the felt with the preferred enzyme preparation; or by removing the felt and treating it with enzyme preparation in a soaking tub, etc. The last of these methods is less practical where an object is to postpone removal of the press-felt, which is a complex and lengthy procedure that leaves a machine down for long periods of time. Although eventually the felt has to be replaced, even where the subject invention is used, the aim here is to extend the period of continuous usage significantly by employing an appropriate enzymatic preparation in the dry stage of the papermaking process.

The inventors believe favorable performance of their method in treating pieces of used felt to remove unwanted deposits, according to the Examples herein, indicates that such treatment would increase the effective life of these felts when treated either continuously or intermittently on the papermaking machine compared with conventional felt conditioning systems. At the least, it is clear that improved cleaning of felts removed from an actual machine has been shown using the invention.

A preferred enzymatic commercial cellulase/hemicellulase preparation found suitable by the inventors is Liftase A40 (manufacturer Genencor International Europe Ltd.), which product has a CMCase activity (carboxymethyl cellulase activity) of approximately 2,500 U/ml, a filter paper activity (FPU activity) of approximately 110 U/ml and a xylanase activity of 500 U/ml. The carboxymethyl cellulase activity and the filter paper activity describe the cellulolytic activity, and the xylanase activity describes the hemicellulolytic activity.

The determination of the filter paper activity is described in Ghose, T. K., Patnak, A. N., Bisaria, V. S., Symposium of Enzymatic Hydrolysis of Cellulose, Bailey, M., Enari, T. M., Linko, M., Eds. (SITRA, Aulanko, Finland, 1975), 111–136; the determination of the CMCase activity is described in Mandels, M., Weber, J., Adv. Chem. Ser. 95 (1969) 391–413; and the determination of the xylanase activity is described in Khan, A. W., Tremblay, D., LeDuy, A., Enzyme Microb. Technol., 8 (1986) 373–377. This preparation was used in all the following Examples given for the invention.

The felts used in the Examples were obtained from different manufacturers where they were used with various paper webs. In summary, six sources contributed 3 pickup felts, 2 first press felts and 1 third press felt. The products made were food board, bleached market pulp, book and writing papers, bond or xerograhic papers, specialty papers, sulfite printing papers and newsprint. The pH of the felts ranged between 3.9–6.5, while the operating life of the felts when removed from service ran between 22–112 days.

The press felts were, all of them, 100% polyester fibre, which reflects most press felts used currently.

Although operating temperatures of the felts varied with machine and position, ranges can be expected to run from 40–60° C.

Various data on the six felts analyzed includes weight, caliper and air and water permeability of the new and used felts, respectively. They were compared with characteristic profiles of physical properties for these types of felts. Also, data on the ash content.solvent extractables, alkali solubles and cellulosic fines was collected.

EXAMPLE 1

To determine the efficacy of the technique, a portion of a used papermachine felt which was removed from production was obtained, and the nature of the deposits was determined. The sample was divided into two sections by cutting in the cross machine direction and marked with notices cut on the edges. Half of the felt sample was subjected to an enzymatic treatment in which 25 ml. of the enzyme preparation was made using "Liftase A40", available from Genencor, Inc., diluted in 475 ml. of distilled water at 45° C. Enzymatic activity dosages may readily be determined by those skilled in the art from the strength of the commercially-available "Liftase A40", given the parameters of use set forth herein. This temperature was maintained in a water bath. The felt sample was soaked in the enzyme solution for one hour with gentle mixing of the solution every ten minutes. Initial pH of the enzyme solution was 4.9 and final pH after one hour was 5.5.

The felt sample was rinsed in 70° C. distilled water. It was then soaked in a solution of 0.01N. NaOH at 80° C. for 5 minutes to deactivate any remaining enzyme, and given a final rinse in 70° C. tap water for one hour to remove NaOH. The other half of the felt sample was given the same treatment except that an additional 25 ml. of distilled water was substituted for the enzyme charge. This felt portion was used as a control test for comparison purposes. Both the treated and control felts were tested for air and water permeability.

Felt characteristics are given in Table 1 and test data are shown in Table 2 for a sample of a newsprint machine pickup felt removed after 36 days of operation. The low amount of mineral fillers is indicative of the fact that little or no mineral fillers are typically used in newsprint production.

TABLE 1

Characteristics of Felt No. P-N-1

| Felt Position Product | Pickup Newsprint |
|---|---|
| pH | 4.0 |
| Mineral Ash Content | 0.29% |
| Solvent Soluble Content | 2.04% |
| Alkali Solubles | 3.21% |
| Cellulosic Fines | 2.71% |

TABLE 2

Results of Enzymatic Treatment of Felt No. P-N-1

| | Enzyme Treated | Control | % Improvement |
|---|---|---|---|
| Air Permeability (CFM) | 9.0 | 8.7 | 3.4 |
| Water Permeability (gal/min/ft$^2$) | 9.93 | 8.13 | 22.1 |

As can be seen from Table 2, a slight increase in air permeability occurred due to the enzyme treatment. Air permeability is the test often used to determine the openness of a felt during its operation. Water permeability is a more difficult test to run, but is believed to be somewhat more representative of the level of filling up of a felt with deposits. The water permeability showed a very significant increase of 22.1%. It should be noted that these increases would be due solely to removal of deposit materials by enzymatic action in situ and not to any removal of loosened or weakened deposits by subsequent chemical or mechanical action which would have the effect of greatly enhancing these improvements.

EXAMPLE II

Another pickup felt removed after 69 days of operation on a machine producing fine and specialty papers was considered to have a moderately high degree of filling, mostly due to mineral fillers. Mineral fillers are used extensively in fine and specialty papers. Felt characteristics are shown in Table 3 and test data are given in Table 4.

TABLE 3

Characteristics of Felt No. P-F-1

| Felt Position Product | Pickup Fine and Specialty Papers |
|---|---|
| pH | 3.9 |
| Mineral Ash Content | 9.53% |
| Solvent Soluble Content | 1.02% |
| Alkali Solubles | 3.12% |
| Cellulosic Fines | 1.74% |

TABLE 4

Results of Enzymatic Treatment of Felt No. P-F-1

| | Enzyme Treated | Control | % Improvement |
|---|---|---|---|
| Air Permeability (CFM) | 20.3 | 20.6 | (1.5) |
| Water Permeability (gal/min/ft$^2$) | 21.58 | 19.21 | 12.3 |

This is a very difficult situation, with the filling mostly due to mineral fillers which are not susceptible to enzyme attack. In this case the air permeability data show little change (actually a slight, but probably insignificant, decrease) while the water permeability data indicate a small increase. In a system such as this, it could be anticipated that smaller, but still significant improvements, mainly through the mechanism of loosening and weakening of the large amount of mineral filler deposits and subsequent mechanical action, could be obtained.

EXAMPLE III

A third example of a pickup felt is shown by a felt removed from a machine manufacturing bond and book papers after 48 days in operation. Felt characteristics are shown in Table 5 and results of enzymatic treatment in Table 6.

TABLE 5

Characteristics of Felt No. P-B-1

| Felt Position Product | Pickup Bond and Book Papers |
|---|---|
| pH | 5.8 |
| Mineral Ash Content | 7.02% |
| Solvent Soluble Content | 1.42% |
| Alkali Solubles | 2.47% |
| Cellulosic Fines | 3.24% |

TABLE 6

Results of Enzymatic Treatment of Felt No. P-B-1

| | Enzyme Treated | Control | % Improvement |
|---|---|---|---|
| Air Permeability (CFM) | 21.8 | 18.6 | 17.2 |
| Water Permeability (gal/min/ft$^2$) | 15.0 | 12.8 | 17.2 |

This machine makes products which incorporate mineral fillers in virtually all grades and occasionally very heavy use of such materials especially in book grades. As in the previous example, it can be seen that much of the heavy amount of filling is due to mineral filters. However, in this case, the pH and content of cellulosic fillers is somewhat higher, which may account for the improved results of enzymatic treatment in this case relative to Example II above which also had a high mineral filler content. Microscopic examination showed that most of the filler deposits were located in the base structure of the felt.

EXAMPLE IV

This felt, characterized in Table 7, was removed from the first press of a machine making book and printing grades using sulfite pulp. Felt life was short, only 28 days, and the felt had suffered considerable loss of water permeability and some damage due to vigorous cleaning efforts with high pressure water showers. During the life of the felt, air permeability had not decreased to the same extent as water permeability, and the enzyme treatment results, shown in Table 8, are consistent with this, showing little change in air permeability, but a substantial recovery in water permeability. It is worth noting that this gain was achieved on a felt containing deposits which had already been subjected to the maximum amount of mechanical cleaning possible with high pressure water showers.

TABLE 7

Characteristics of Felt No. F-SB-1

| Felt Position Product | First Press Sulfite Book & Printing Papers |
|---|---|
| pH | 6.5 |
| Mineral Ash Content | 2.85% |
| Solvent Soluble Content | 0.91% |
| Alkali Solubles | 3.16% |
| Cellulosic Fines | 2.24% |

TABLE 8

Results of Enzymatic Treatment of Felt No. F-SB-1

| | Enzyme Treated | Control | % Improvement |
|---|---|---|---|
| Air Permeability (CFM) | 19.2 | 20.2 | (5.0) |
| Water Permeability (gal/min/ft$^2$) | 11.66 | 8.65 | 34.8 |

EXAMPLE V

This felt, characterized in Table 9, was removed from the first press of a board machine manufacturing food board, packaging boards, and some bleached kraft market pulp, after 112 days of operation. This is a very long period of operation for a wet press felt. Results are similar to that encountered in Example IV. The felt experienced a greater loss of water permeability during its lifetime than air permeability because of predominantly mineral filler deposits, and recovery of water permeability was greater than for air permeability as shown in Table 10. One significant difference between this case and that in Example IV is the much lower felt pH which gives an indication of the applicability of the treatments to a range of pH conditions which might be encountered in industrial situations.

TABLE 9

Characteristics of Felt No. F-FB-1

| Felt Position Product | First Press Food Board |
|---|---|
| pH | 4.6 |
| Mineral Ash Content | 6.82% |
| Solvent Soluble Content | 0.89% |
| Alkali Solubles | 0.28% |
| Cellulosic Fines | 2.64% |

TABLE 10

Results of Enzymatic Treatment of Felt No. F-FB-1

| | Enzyme Treated | Control | % Improvement |
|---|---|---|---|
| Air Permeability (CFM) | 15.0 | 15.3 | 2.0 |
| Water Permeability (gal/min/ft$^2$) | 12.49 | 9.80 | 27.4 |

EXAMPLE VI

This is an example of a third press felt removed from a machine manufacturing fine papers and boards. In this case the felt was removed after 22 days of operation due to mechanical damage, but was found to be heavily filled as well. It can be seen in Table 11 that the filling deposits are mostly mineral fillers and alkali soluble materials, with relatively low levels of cellulosic fillers. This felt also differs from those in Examples IV and V in that the loss in water permeability during the operating period was not as severe. Data for enzyme treatment shown in Table 12 show a very significant improvement in both water and air permeability for this felt after treatment.

TABLE 11

Characteristics of Felt No. T-F-1

| Felt Position Product | Third Press Fine Papers |
|---|---|
| pH | 6.1 |
| Mineral Ash Content | 5.42% |
| Solvent soluble content | 0.87% |
| Alkali Solubles | 5.15% |
| Cellulosic Fines | 1.02% |

TABLE 12

Results of Enzymatic Treatment of Felt No. T-F-1

| | Enzyme Treated | Control | % Improvement |
|---|---|---|---|
| Air Permeability (CFM) | 6.9 | 1.74 | 297 |
| Water Permeability (gal/min/ft$^2$) | 11.2 | 2.43 | 361 |

TABLE 13

Wet Press Felt Treatment with Liftase A40 Applied to "Used" and "Filled" Felts

| | AFTER ENZYME TREATMENT | | NO ENZYME TREATMENT | |
|---|---|---|---|---|
| Felt No. | Air Permeability, CFM | Water Permeability, Gal/Min/Ft2 | Air Permeability, CFM | Water Permeability, Gal/Min/Ft2 |
| 1 | 20.3 | 21.58 | 20.6 | 19.21 |
| 2 | 6.9 | 11.2 | 1.74 | 2.48 |
| 3 | 21.8 | 15.0 | 18.6 | 12.8 |
| 4 | 9.0 | 9.93 | 8.7 | 8.13 |
| 5 | 19.2 | 11.66 | 20.2 | 8.65 |
| 6 | 15.6 | 12.49 | 15.3 | 9.80 |

PERMEABILITY, AVERAGE INCREASE=9.0.
WATER PERMEABILITY, AVERAGE INCREASE=34.1%

From the data collected on the subject felts, as further indicated by the Examples, it can be shown that overall: the felts tested exhibited an average increase in water permeability of 34.1%, and an average increase in air permeability of 9.0%. The inventors believe that little, if correlation exists between these permeability gains and the felt characteristics, filler characteristics, felt position, felt life (i.e., time used on the machine) and product type. This ultimately indicates that the invention works within a variety of parameters and can be delivered using a variety of cleaning methods.

The enzymatic treatments are safe for synthetic felts, while any enzyme contacting the paper web will become denatured in conventional dryers. It is expected that the enzyme would be advantageous to use in process given a variety of conditions of temperature, pH, enzyme concentration and time. It is further expected that the present method will enhance effectiveness of known mechanical and detergent treatments currently used to condition felts.

What is claimed is:

1. A method of treating a felt to remove contaminants therein, said method comprising the steps of:

providing a felt used in transporting paper webs;

a preparing an enzyme solution comprising an enzyme selected from the group consisting of a cellulase, a hemicellulase, and mixtures thereof, said enzyme solution having a first pH of 4.9;

applying said enzyme solution to said felt for a first predetermined period of time wherein said first pH of said enzyme solution changes from 4.9 to 5.5 after said first predetermined period of time;

rinsing said felt with distilled water at a first temperature;

applying a solution of sodium hydroxide to said felt to remove said enzyme solution; and rinsing said felt with tap water to remove said solution of sodium hydroxide, thereby removing said contaminants present therein.

2. The method according to claim 1, wherein said first predetermined period of time is one hour.

3. The method according to claim 1, wherein said first temperature is 70° C.

4. The method according to claim 1, wherein said solution of sodium hydroxide has a concentration of 0.01N.

5. The method according to claim 1, wherein said step of rinsing said felt with said tap water is carried out for one hour.

* * * * *

UNITED STATES PATENT AND TRADEMARK OFFICE

CERTIFICATE OF CORRECTION

PATENT NO. : 5,961,735
DATED : October 5, 1999
INVENTOR(S) : Heitmann, Jr. et al.

It is certified that error appears in the above-identified patent and that said Letters Patent is hereby corrected as shown below:

Title page,
Item [75] Inventors: "John A. Heitmann, Jr.; Thomas W. Joyce, both of Raleigh, N.C." should read -- John A. Heitmann, Jr., Raleigh, N.C.; Thomas W. Joyce, Kalamazoo, Mich. --.

Column 11,
Line 50, "PERMEABILITY" should read -- AIR PERMEABILITY --.

Column 12, claim 1,
Line 25, "a preparing" should read -- preparing --.

Column 12, claim 5,
Line 48, "with said tap water" should read -- with tap water --.

Signed and Sealed this

Sixth Day of November, 2001

*Attest:*

Nicholas P. Godici

NICHOLAS P. GODICI
*Acting Director of the United States Patent and Trademark Office*

*Attesting Officer*